US008164412B2

(12) United States Patent
Sieber et al.

(10) Patent No.: US 8,164,412 B2
(45) Date of Patent: Apr. 24, 2012

(54) THERMAL LINK AND METHOD FOR PRODUCING SAID LINK

(75) Inventors: Peter Sieber, Nürnberg (DE); Roland Wolf, Hersbruck (DE); Lutz Pahlke, Nürnberg (DE)

(73) Assignee: Inner Control Hermann Kohler Electrik GmbH & Co. KG, Nuremberg (DE)

( * ) Notice: Subject to any disclaimer, the term of this patent is extended or adjusted under 35 U.S.C. 154(b) by 569 days.

(21) Appl. No.: 11/922,907

(22) PCT Filed: Jun. 27, 2006

(86) PCT No.: PCT/EP2006/006169

§ 371 (c)(1),
(2), (4) Date: May 21, 2009

(87) PCT Pub. No.: WO2007/000309

PCT Pub. Date: Jan. 4, 2007

(65) Prior Publication Data

US 2009/0261940 A1 Oct. 22, 2009

(30) Foreign Application Priority Data

Jun. 28, 2005 (DE) ..... 20 2005 010 133 U
Dec. 20, 2005 (DE) ..... 10 2005 060 965

(51) Int. Cl.
*H01H 85/50* (2006.01)

(52) U.S. Cl. ..... 337/299; 337/213; 337/401

(58) Field of Classification Search ..... 337/213, 337/299, 401
See application file for complete search history.

(56) References Cited

U.S. PATENT DOCUMENTS

| | | | | | |
|---|---|---|---|---|---|
| 3,291,945 | A | * | 12/1966 | Merrill et al. | 337/403 |
| 4,145,654 | A | * | 3/1979 | Grimm | 337/407 |
| 4,307,370 | A | * | 12/1981 | Hollweck | 337/299 |
| 4,366,462 | A | * | 12/1982 | Hollweck | 337/409 |
| 4,929,922 | A | * | 5/1990 | Hollweck | 337/407 |
| 5,138,297 | A | * | 8/1992 | Hollweck | 337/354 |
| 5,182,538 | A | * | 1/1993 | Muller | 337/102 |
| 5,831,507 | A | * | 11/1998 | Kasamatsu et al. | 337/4 |
| 6,348,851 | B1 | * | 2/2002 | Wyser et al. | 337/411 |

FOREIGN PATENT DOCUMENTS

| | | | |
|---|---|---|---|
| DE | 2826205 | A1 | 12/1979 |
| DE | 2942478 | A1 | 4/1981 |
| DE | 20 2005 010133 | U1 | 11/2005 |

* cited by examiner

*Primary Examiner* — Anatoly Vortman
(74) *Attorney, Agent, or Firm* — Kubotera & Associates, LLC

(57) ABSTRACT

The invention relates to a thermal link (1) for electrical appliances, comprising an insulating part (10) with electrical terminals (11) and contact springs (12) for providing electrical contact between said terminals (11), a fusible material insert (15) that acts as the thermal trip element and a transmission pin (13), which is displaceably mounted in the insulting part (10), one end of which engaging with the fusible material insert (15) and the other end with the contact springs (12). Said link is characterised in that the fusible material insert (15) is situated in a casing (141) that is configured as one piece with the heat transfer plate (14). The invention also relates to a method for producing a thermal link (1) comprising the following steps: the casing (141) for housing the fusible material insert (15) and the casings (144) that connect the heat transfer plate (14) to the insulating part (10) are drawn from the heat transfer plate (14); the fusible material insert (15) is inserted into the casing (141) and formed; the insulating part (10) is placed on the heat transfer plate (14) and connected in a positive fit to the graduated inner sections (107) of the inner cavities (108) by means of the casings (144).

14 Claims, 18 Drawing Sheets

THERMAL LINK AND METHOD FOR PRODUCING SAID LINK

BACKGROUND OF THE INVENTION AND RELATED ART STATEMENT

The present invention relates to a thermal link for electrical appliances, comprising an insulating part with electrical terminals and contact springs for producing an electric current path, a heat transfer plate, a fusible material insert as a thermal trip and a transmission pin of insulating material, which is displaceably mounted in the insulating part and engages at its one end with the fusible material insert and at its other end with a contact spring, and the biased contact spring pressing the pin downward after melting of the fusible material and thereby separating a contact of the contact spring. The present invention also relates to a method for producing such a thermal link.

Thermal links are known from the prior art, for example from DE 2826205 A1, where a fusible material is arranged inside a casing that is open at the top and bottom and is arranged on the heat transfer plate and in a recess of the insulating part. However, the many individual parts of such thermal links, comprising a heat transfer plate, a casing, a fusible material, an insulating part with a corresponding recess and a transmission pin, require a considerable assembly effort. Furthermore, when various fusible solders come into contact with oxygen, oxidation may cause their melting point to change.

The object of the present invention is therefore to provide a thermal link which overcomes the disadvantages of the prior art and can be produced at low cost with little assembly effort, the object of the present invention also being to provide a reliable method for producing a thermal link that is also suitable for large-scale production.

SUMMARY OF THE INVENTION

The object of the present invention is achieved by the features of the invention. Advantageous embodiments are mentioned in the features of the description which follows.

DETAILED DESCRIPTION OF PREFERRED EMBODIMENTS

Figure 1A:
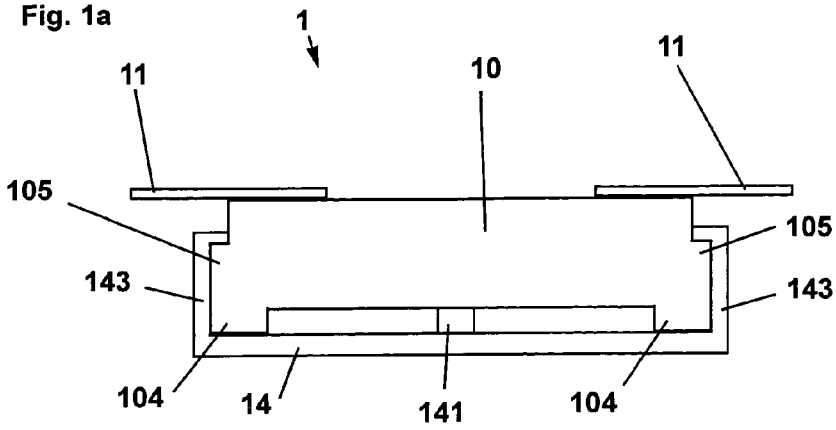
FIG. 1*a* shows a schematic side view of a thermal link according to the invention as provided by one embodiment of the present invention.

A thermal link according to the invention for electrical appliances comprises in particular an insulating part with electrical terminals and a contact spring for providing an electrical connection between the terminals, a fusible material insert as a thermal trip and a transmission pin, which is displaceably mounted in the insulating part and engages at its one end with the fusible material insert and at its other end with the contact springs, the fusible material insert being arranged in a casing that is in one piece with the heat transfer plate. The one-piece form of the casing and heat transfer plate according to the invention makes it possible for the thermal link to be assembled and produced at particularly low cost, the individual parts to be assembled for the final assembly of the thermal link being reduced considerably in comparison with the prior art. In particular, the casing can be drawn from the heat transfer plate during the production of the heat transfer plate and the fusible material can subsequently be pressed into the casing created, it being ensured that the fusible material has particularly effective thermal contact with the heat transfer plate and is only exposed in the upward direction.

Suitably formed around the casing in the heat transfer plate is an annular depression, which can likewise be provided in one operation with the drawing of the casing from the heat transfer plate. The annular depression surrounding the casing is particularly advantageous for receiving melted fusible material from the casing, so that it is ensured that, when the thermal link is tripped, no fusible material escapes to the outside or even gets to the contact springs and impairs the function of the thermal link or the electrical appliance.

One embodiment of the present invention provides that a thermal link according to the invention may suitably comprise an insulating part with two lateral foot parts in contact with the heat transfer plate, the bottom being at a distance from the heat transfer plate. The pin is suitably arranged in a through-hole of the insulating part and a circular recess is formed on the bottom of the insulating part, within which recess the hole is formed. The distance of the bottom from the heat transfer plate and the circular recess on the bottom of the insulating part in the area around the through-hole are suitably formed in a way corresponding to the casing such that the casing corresponds with its upper rim approximately to the recess in the bottom of the insulating part. This additionally provides space for any melted fusible material.

The inside diameter of the casing suitably corresponds approximately to the diameter of the transmission pin, so that the fusible material is largely enclosed, and protected from contact with oxygen and consequently protected from oxidation, not only by the casing and the heat transfer plate but also at the top by the transmission pin.

A further advantageous embodiment of the present invention provides that a thermal link according to the invention may also suitably comprise furthermore an insulating part with at least one further recess with an inner graduation, which corresponds to a casing drawn from the base plate, the upper rim of the casing engaging around the inner graduation in such a way that the heat transfer plate is firmly connected to the insulating part. Here, the heat transfer plate and the insulating housing are formed particularly advantageously in such a way that the heat transfer plate can be fitted with the insulating housing and the fusible solder from above, and the insulating housing can be fitted with the transmission pin and the terminals likewise from above.

The heat transfer plate of a thermal link according to the invention may also be advantageously formed in one piece with the base plate and/or the heat transfer plate of at least one other thermal link and/or a temperature switch, which provides further simplifications and cost advantages in assembly, including in the electrical appliance, and also has the advantageous effect of providing a sensing location for the temperature to be monitored that is the same for the link and the temperature switch.

A method according to the invention for producing a thermal link comprises in particular a heat transfer plate from which a casing receiving a fusible material insert and also at least one further casing for connecting the heat transfer plate to an insulating part are drawn, so that a heat transfer plate that can be fitted with components from above is provided. The heat transfer plate corresponds to an insulating part in which suitable recesses are provided, corresponding to the casing for receiving the fusible material insert and the casings for connecting the heat transfer plate to the insulating part. The fusible material insert is inserted into the casing for receiving it and, after that, the insulating part is placed onto the heat transfer plate and is connected to the insulating part with a form fit by way of the casings. After that, a transmission pin is inserted from above into the insulating housing, and the insulating housing is fitted with suitable terminals, likewise from above. The method according to the invention for producing a thermal link, with the heat transfer plate and the insulating part formed in a particularly advantageous manner such that the heat transfer plate and the insulating part can merely be provided with components from above, comprises just a few simple production steps and therefore is, in particular, also particularly inexpensive.

The method according to the invention for producing a thermal link also comprises in particular the stamping of the heat transfer plate to create in it a suitable first casing, receiving a defined volume of fusible material, and at least one further, second casing, forming a cup collar. After that, the fusible material insert is suitably introduced in the form of a ball and pressed into the first casing. After that, the insulating part is connected to the heat transfer plate with a form fit, in that the second casing, and suitably a further casing that likewise forms a cup collar on the heat transfer plate, enter the insulating part and are widened from above by means of a suitable tool, and advantageously a ball stamp, so that the casings come to lie around suitable undercuts of the insulating part. After that, a one-part insulating pin of a predetermined length is suitably introduced to the insulating part in such a way that the insulating pin rests on the fusible material insert of the heat transfer plate.

After that, suitable electrical terminals, to be precise firstly the terminal with the switching spring and then the terminal with the fixed contact, are fastened in the insulating part without rivets. This is suitably and advantageously performed by means of legs that are angled away from the terminals and have at their ends suitably formed and advantageously V-shaped clamps. The legs enter the insulating part likewise from above and are widened from the opposite side by a predetermined force and by means of a suitable tool in such a way that the clamps come to lie around undercuts in the insulating part, it advantageously being possible for the tool to be introduced from below through suitable slits in the heat transfer plate.

The present invention is described in detail below on the basis of the schematic drawings.

Figure 1B:
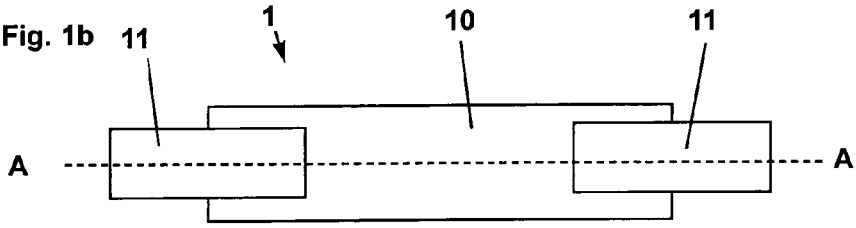
FIG. 1*b* shows the thermal link from FIG. 1*a* from above.

FIG. 1*a* shows a schematic side view of a thermal link 1 according to the invention, comprising electrical terminals 11 and an insulating part 10, which is arranged with both its lateral foot parts 104 on a heat transfer plate 14, which is formed in one piece with a casing 141 for a fusible material 15, and FIG. 1*b* shows the thermal link 1 from above.

Figure 1C:
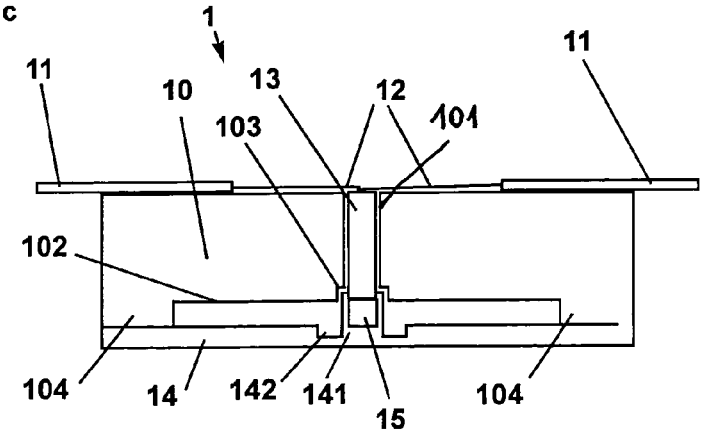
FIG. 1*c* shows a schematic section through the thermal link from FIGS. 1*a* and *b* along the line A-A from FIG. 1*b;*

FIG. 1*c* shows a schematic section through the thermal link 1 from FIGS. 1*a* and 1*b* along the line A-A from FIG. 1*b*, comprising the insulating part 10, the electrical terminals 11, the contact spring 12, a hole 101, passing through the insulating part 10, and the heat transfer plate 14, with the casing 141 and the fusible material 15 arranged inside the casing, and also the transmission pin 13, arranged inside the through-hole 101 and engaging at its one end with the fusible material insert 15 and at its other end with the contact spring 12. Lateral graduations 105, which correspond to fastening arms 143 extending from the heat transfer plate 14, are suitably formed on the insulating part 10, and the fastening arms 143 engage at their ends around the graduations 105, so that the insulating part is firmly arranged on the heat transfer plate 14. The insulating part 10 also has two lateral foot parts 104, which stand on the heat transfer plate 14, the bottom 102 being at a small distance from the heat transfer plate 14. On the bottom 102 of the insulating part 10, a recess 103 that corresponds to the casing 141 is also suitably formed in such a way that the upper rim of the casing 141 is arranged approximately in the recess 103.

Figure 1D:
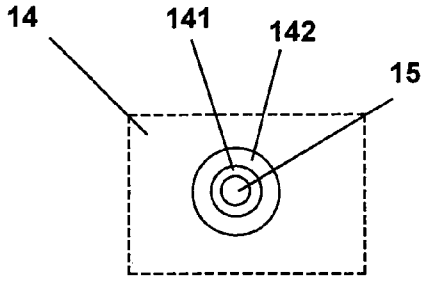
FIG. 1*d* shows a schematic plan view of a partial detail of a heat transfer plate of a thermal link from FIGS. 1*a* and *b*.

FIG. 1*d* shows a schematic plan view of a partial detail of the heat transfer plate 14 with the casing 141 and the annular depression 142, surrounding the casing 141, and the fusible material insert 15, arranged inside the casing 141. The bottom 102, the foot parts 104, the recess 103, the depression 142 and the casing 141 are suitably. formed in such a way that it is ensured that, when the thermal link trips, no fusible material reaches the contact springs or escapes from the thermal link 1.

Figure 2:
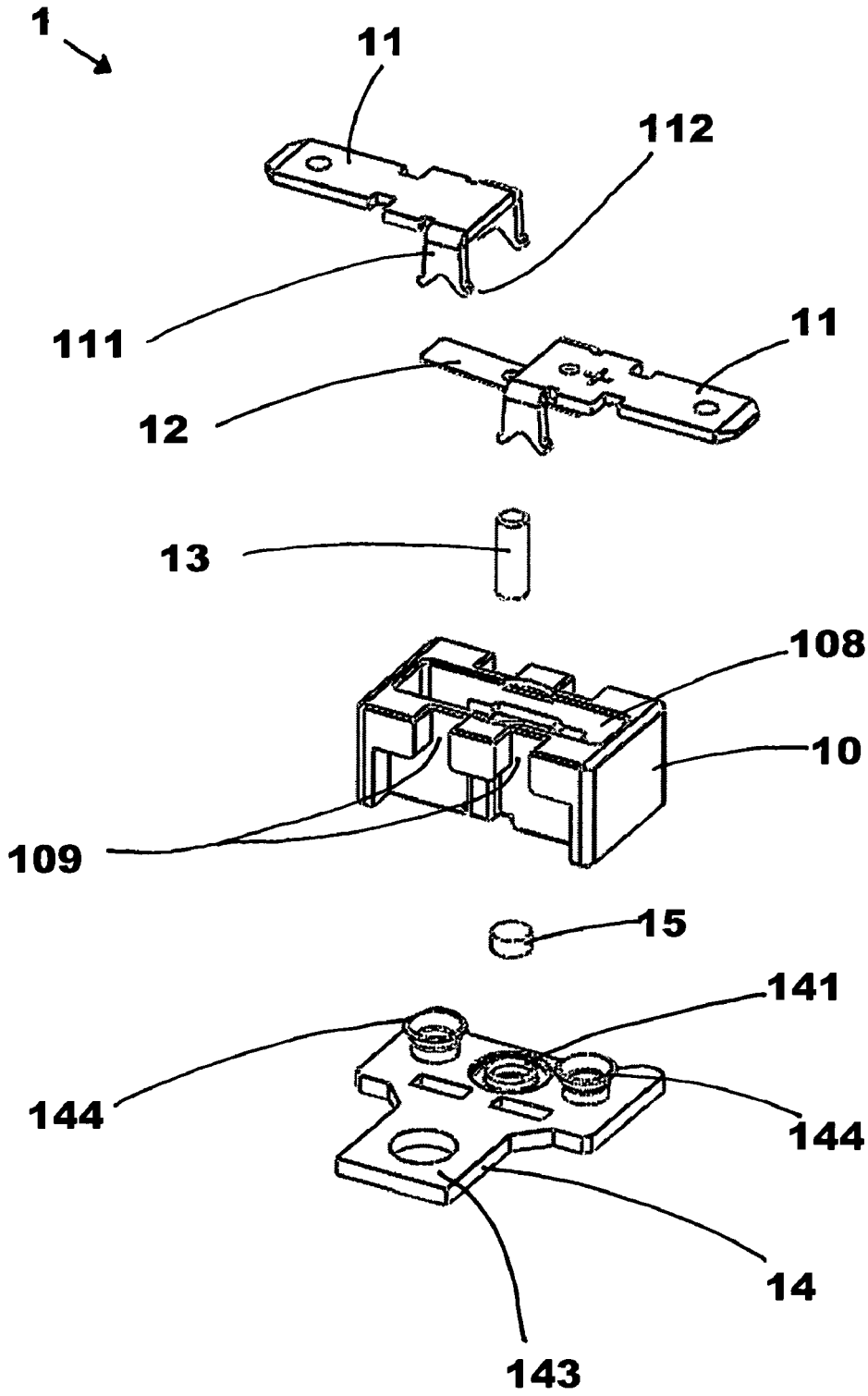
FIG. 2 shows a perspective exploded representation of a thermal link as provided by a further embodiment of the present invention.

FIG. 2 shows a perspective exploded representation of a thermal link as provided by a further embodiment of the present invention, comprising a heat transfer plate 14, an insulating part 10, a fusible material insert 15, a transmission pin 13 and electrical terminals 11. Formed in the base plate 14 is a casing 141 for receiving the fusible material insert 15, which corresponds to the casing 141 of the first embodiment of the present invention described above. Also formed in the heat transfer plate 14 is at least one further casing 144, which corresponds to a suitable recess of the insulating part 10, which is described in detail below on the basis of FIG. 5.

Figure 3A:
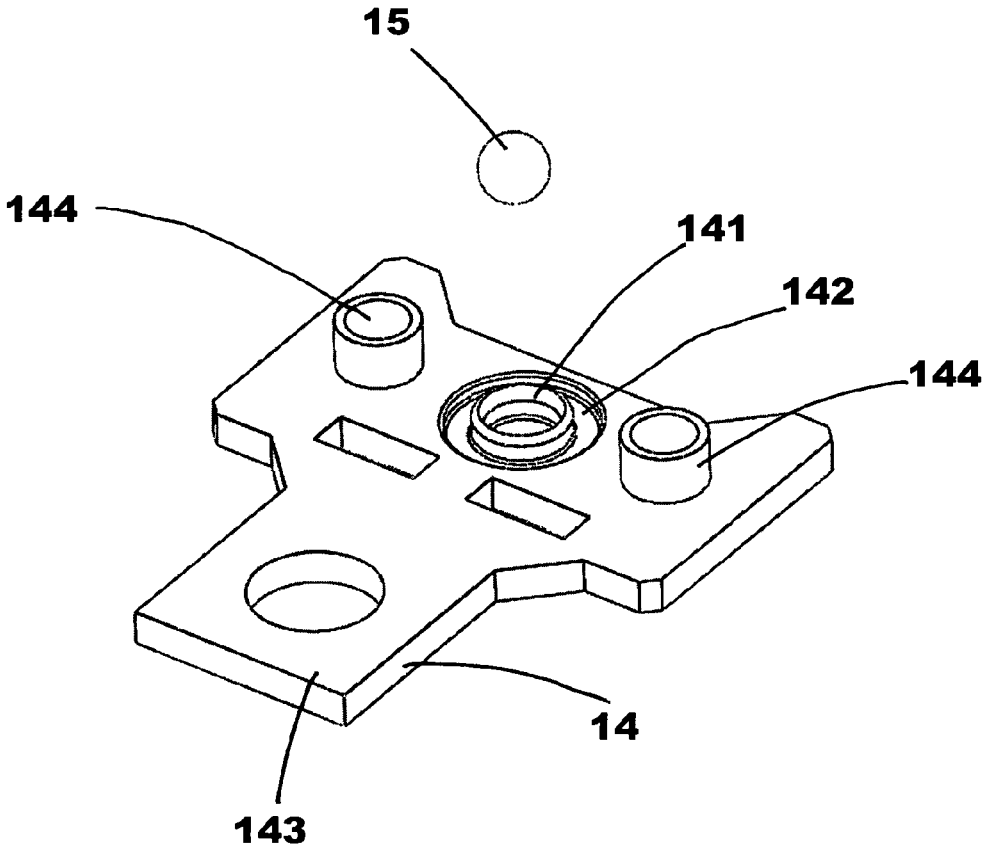
FIGS. 3*a, b* and *c* show the heat transfer plate with the insert of fusible solder of the thermal link from FIG. 2.
Figure 3B:
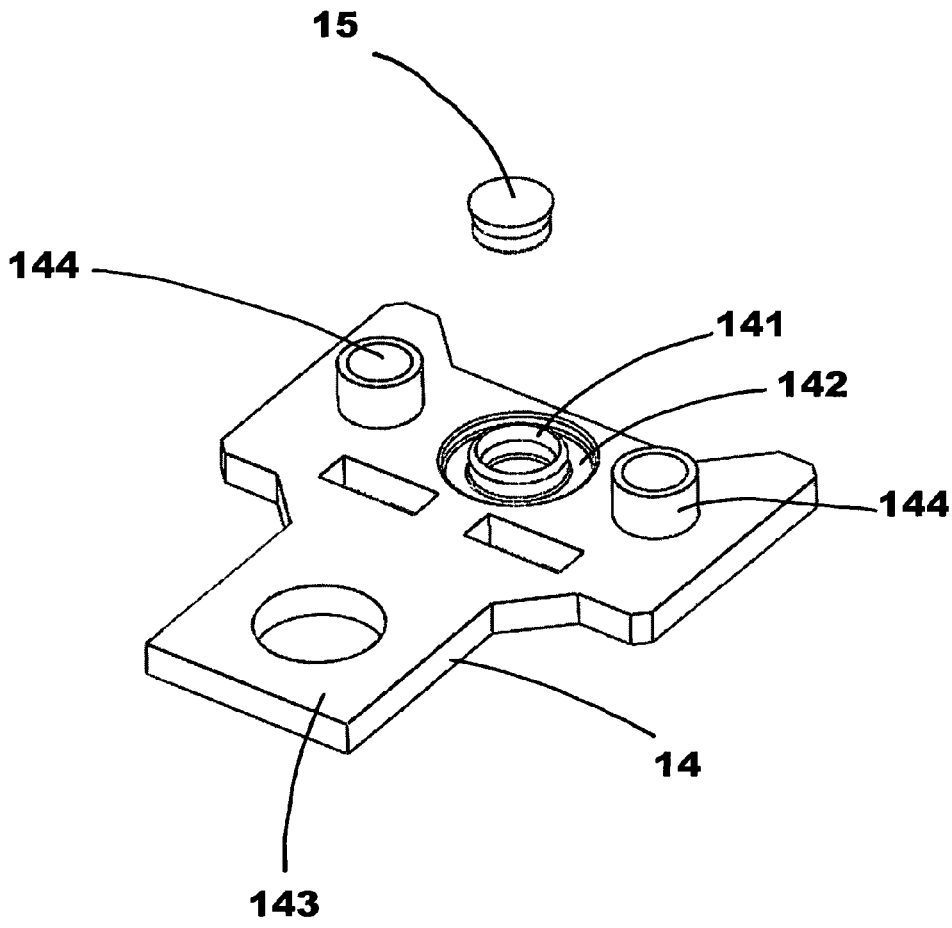
Figure 3C:
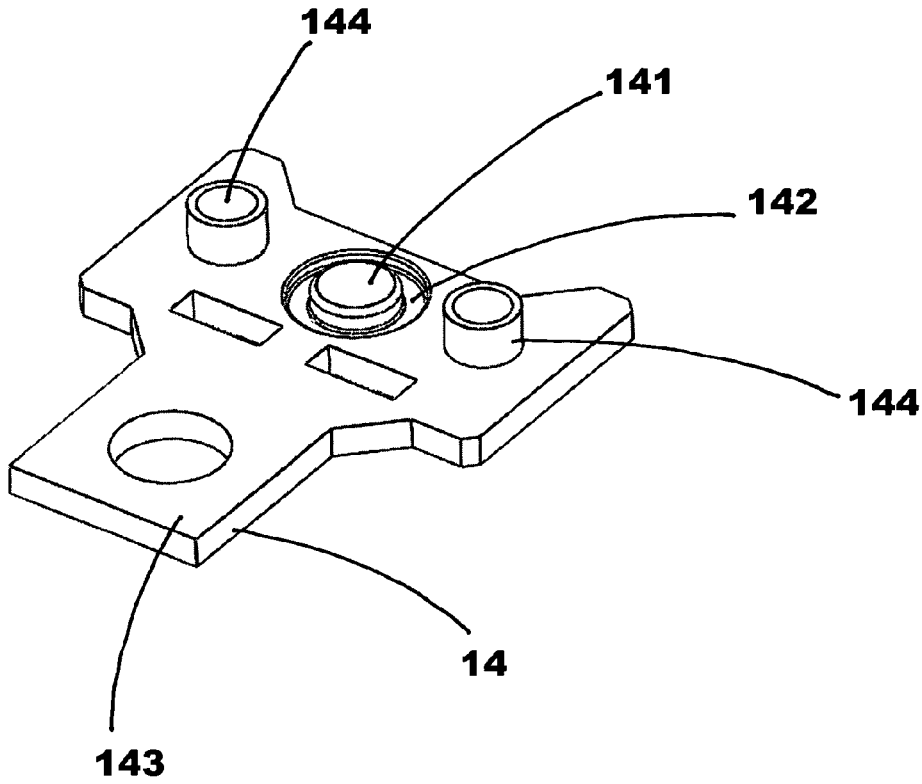

FIGS. 3*a, b* and *c* show an enlarged representation of the heat transfer plate 14 with the casing 141 for receiving the fusible material insert 15, which is suitably arranged midway between two casings 144 for connecting the heat transfer plate to the insulating part 10. The fusible material insert 15 may be formed as a ball or as a piece of wire and is inserted from above into the casing 141 and stamped.

Figure 4A:
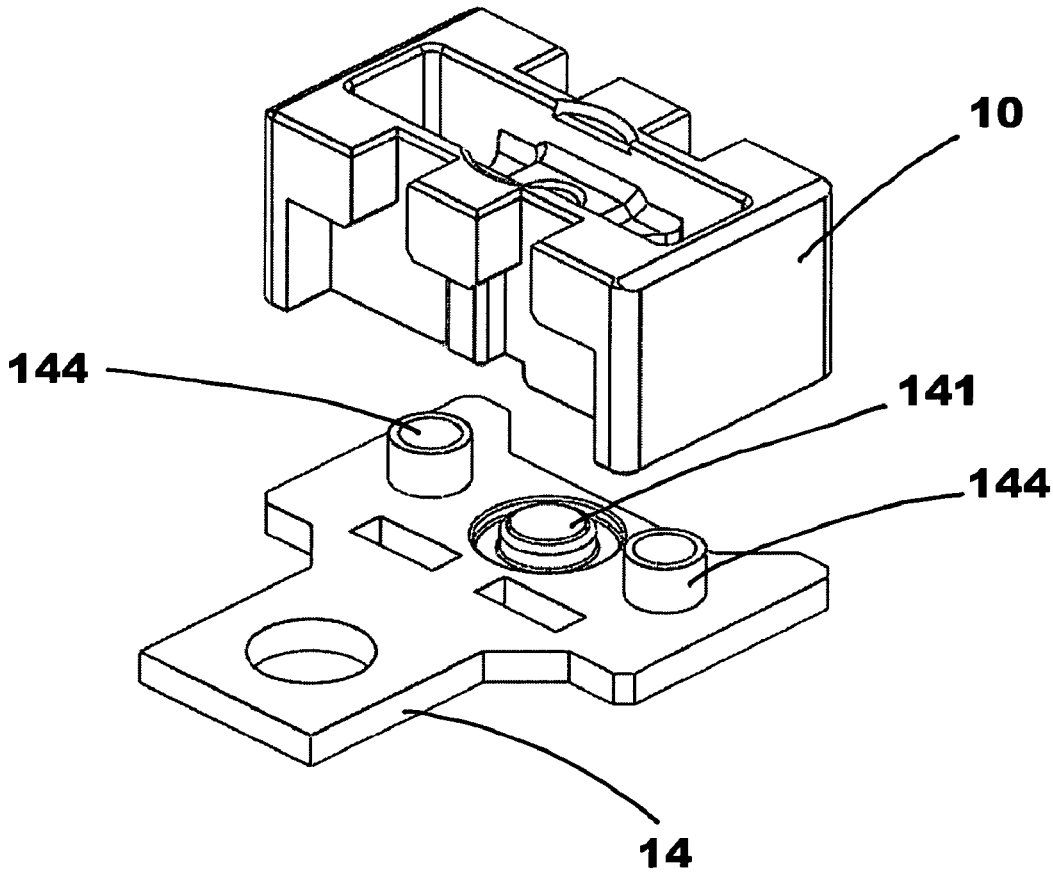
FIGS. 4*a* and *b* show the heat transfer plate with the fusible solder and the insulating part of the thermal link from FIG. 2.
Figure 4B:
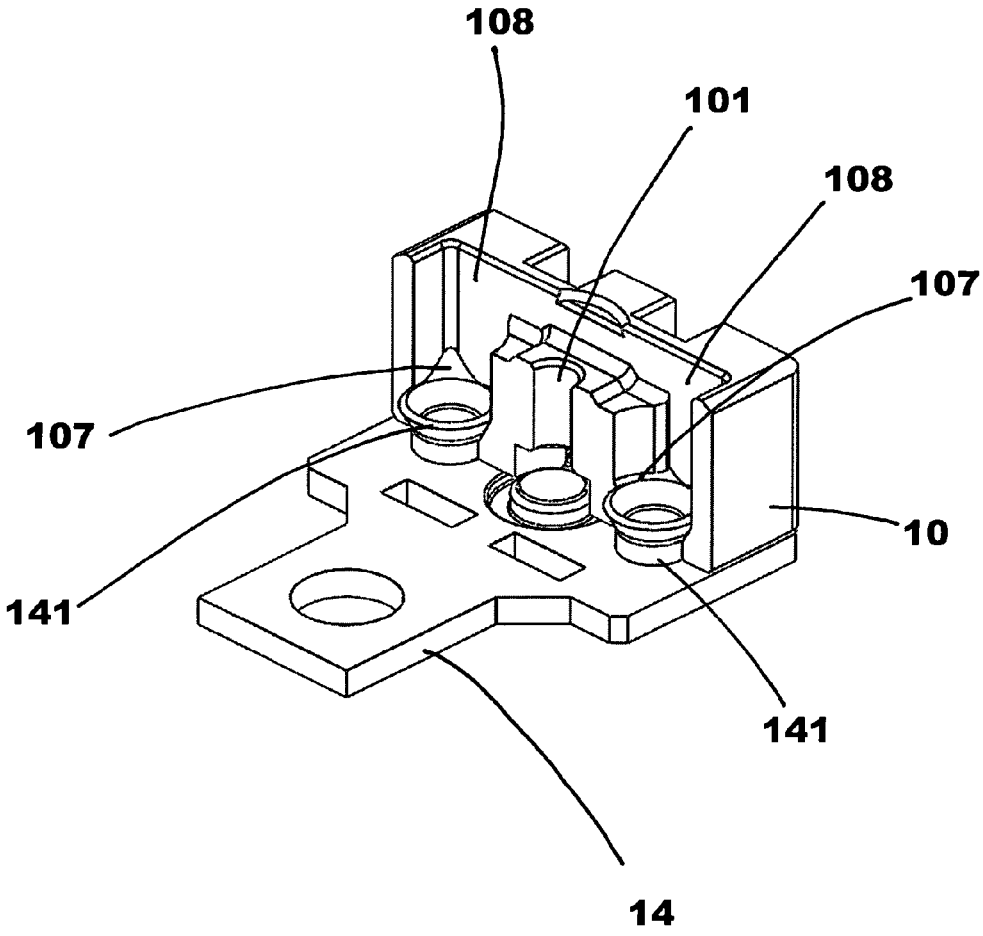

After that, the insulating part 10, with its inner hole 101, which corresponds to the fusible material insert 15 arranged in the casing 141, and with the inner recesses 108, which correspond to the casings 142, is placed from above onto the heat transfer plate 14. Suitable graduations 107 are formed in the inner recesses 108 of the insulating part 10, so that the heat transfer plate 14 and the insulating part 10 are connected with a form fit, in that a stamp that is introduced into the recesses 108 from above is used to make the casings engage around the graduations 107, which is best represented by the partial section of FIG. 4*b*.

Figure 5A:
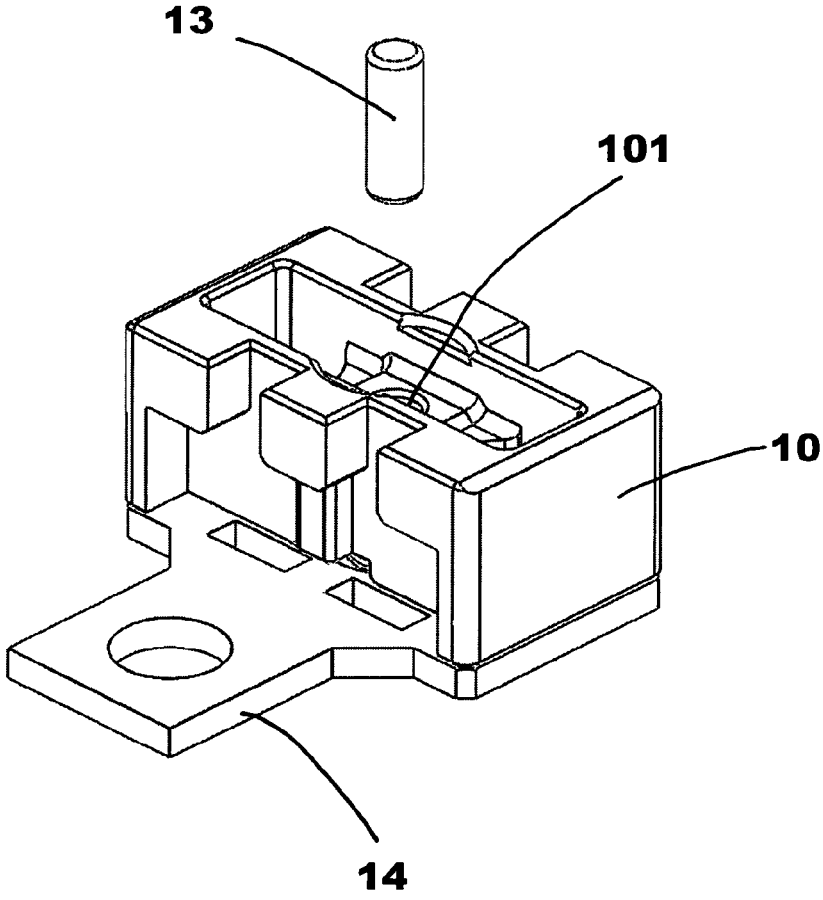
FIGS. 5*a* and *b* show the heat transfer plate with the mounted insulating part and with the transmission pin 13 of the thermal link from FIG. 2.
Figure 5B:
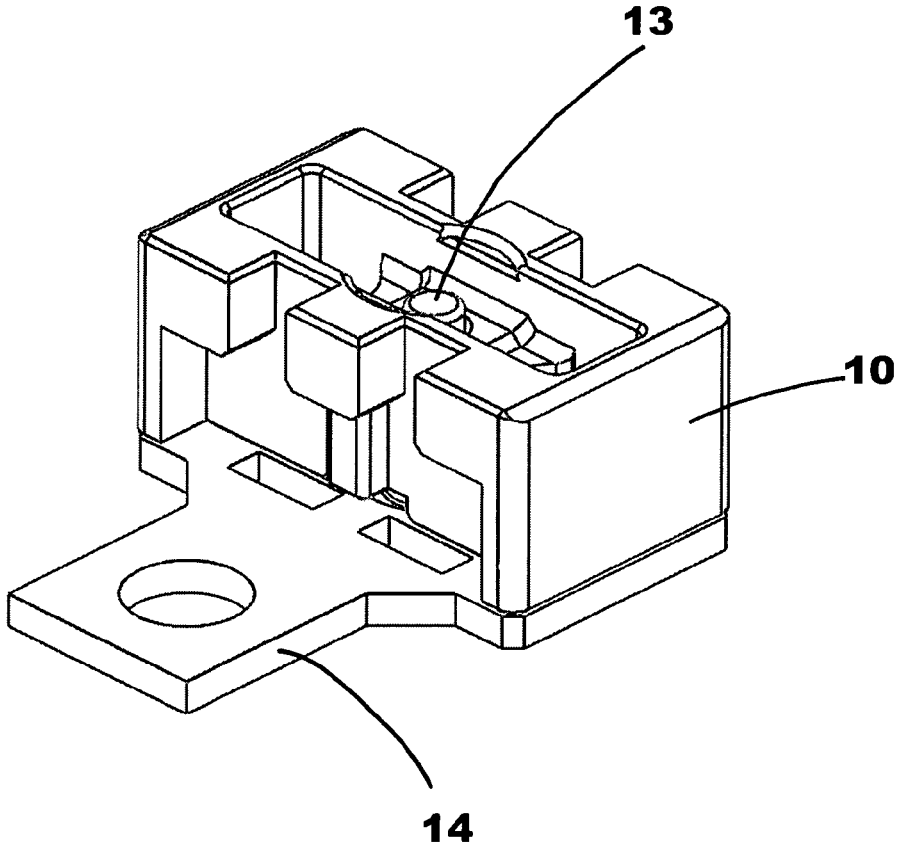

After that, a suitable transmission pin 13 of a suitable insulating material is inserted likewise from above into the hole 101, which is represented in FIGS. 5*a* and 5*b*.

Figure 6A:
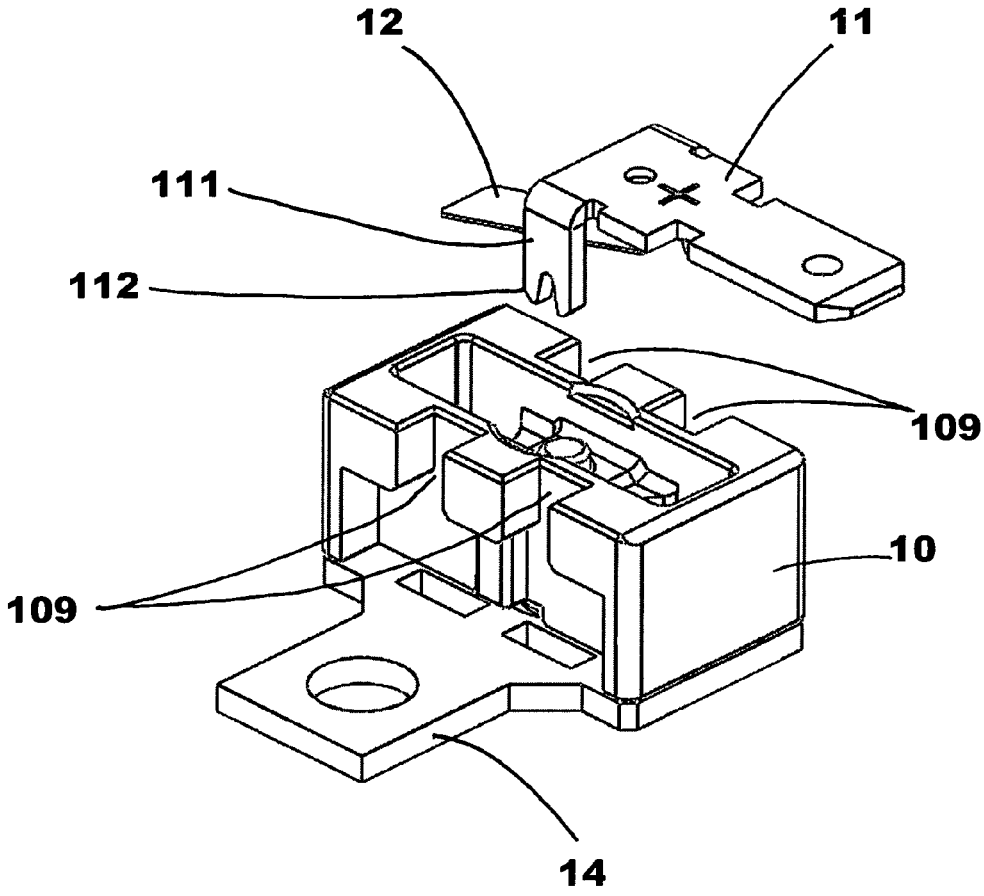
FIGS. 6*a* and *b* show a suitable first terminal with a contact spring for a thermal link as shown in FIG. 2.
Figure 6B:
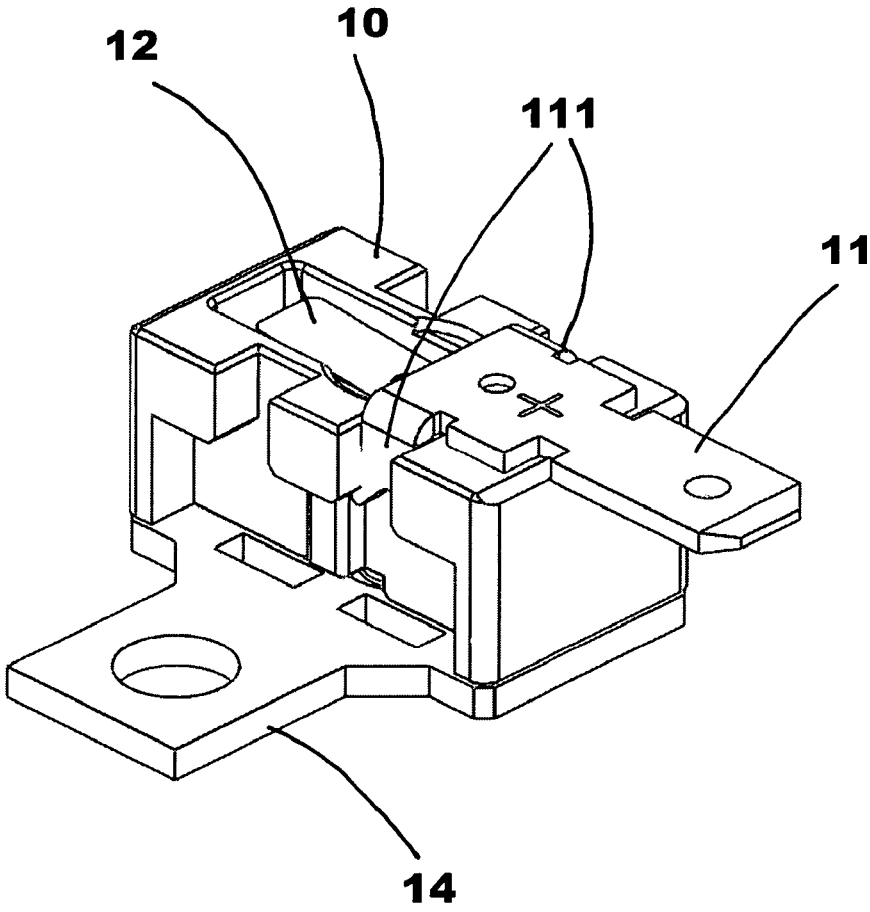

FIG. 6*a* shows a suitable first electrical terminal 11 with a contact spring 12 and suitable fastening legs 111, which is likewise inserted from above into the insulating part 10, and FIG. 6*b* shows the terminal 11 inserted under the biasing of the contact spring 12, the fastening legs 111 being introduced from above into lateral recesses 109 of the insulating housing and fastening clamps 112 that are formed at the lower end of the legs 111 engaging around graduations that are formed on the lateral recesses 109. It is clear that the terminal 11 can be suitably provided in mass production by means of pre-punched terminals hanging on a strip, the legs 111 being suitably bent and the contact spring 12 being riveted to the terminal 11. The contact spring 12 is made of suitable electrically conductive material with a sufficiently constant resilient property up to a temperature of approximately 300° C. and suitably of roll-clad, silver-plated high-grade steel and is fitted in a biased manner, so that it is possible to compensate to the greatest extent for a tolerance of the insulating part 10 suitably consisting of ceramics. The heat transfer plate 14 suitably also comprises a fastening arm 143 and may also comprise suitable recesses for bending up the fastening clamps 112 from below by means of a suitable tool.

Figure 7A:
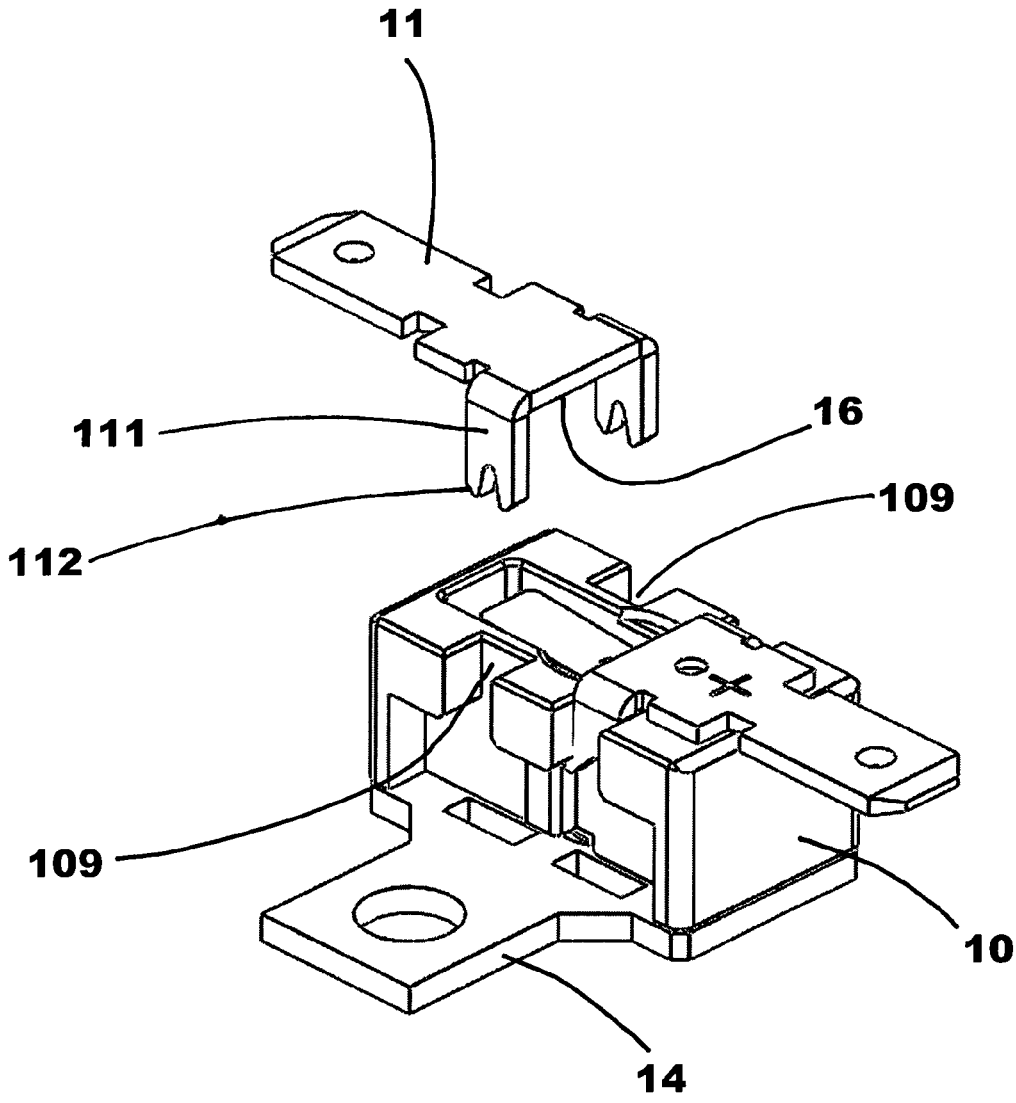
FIGS. 7*a* and *b* show a suitable second terminal for a thermal link as shown in FIG. 2.
Figure 7B:
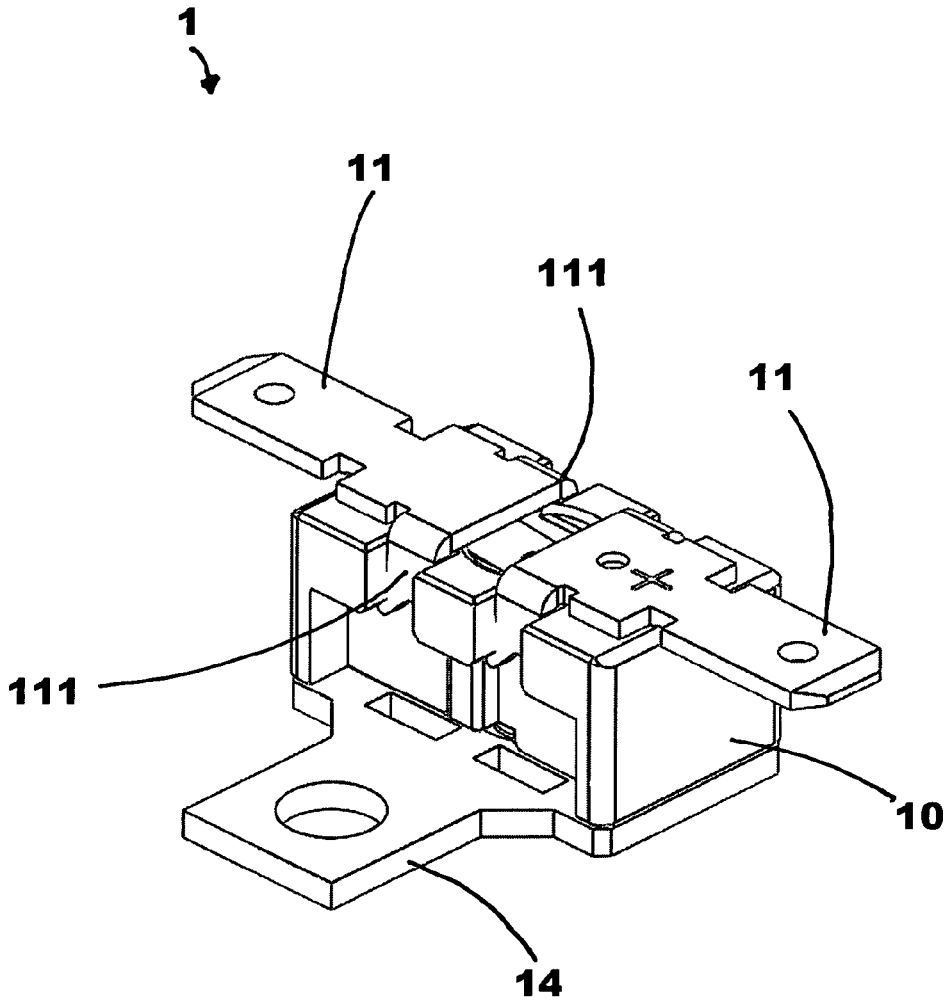

FIGS. 7*a* and *b* show a second electrical terminal 11, which is formed in a way analogous to the first electrical terminal 11 and suitably without the contact spring with a fixed contact 16, and is likewise inserted from above into the insulating part 10 and connected to the insulating part 10 with a form fit in a way analogous to the first electrical terminal 11.

Figure 8A:
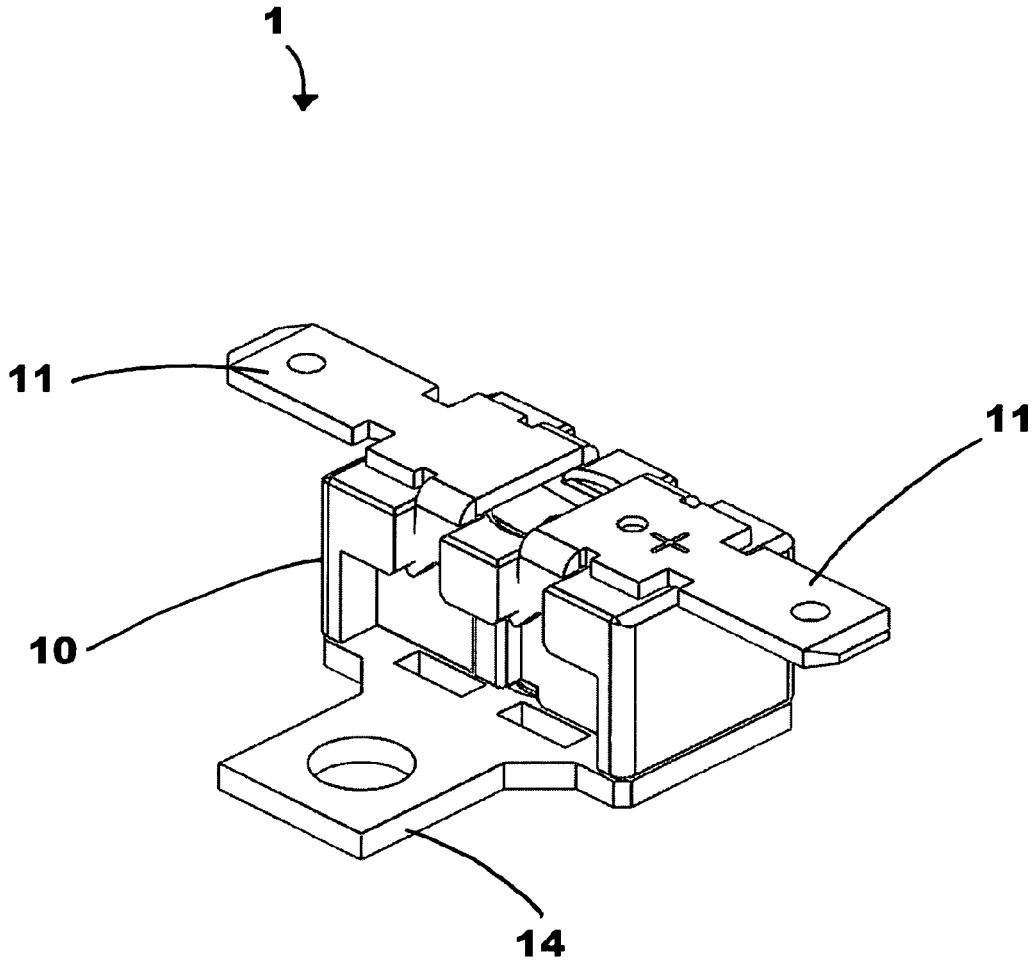
FIG. 8*a* shows a perspective representation of a mounted thermal link from FIG. 2
Figure 8B:
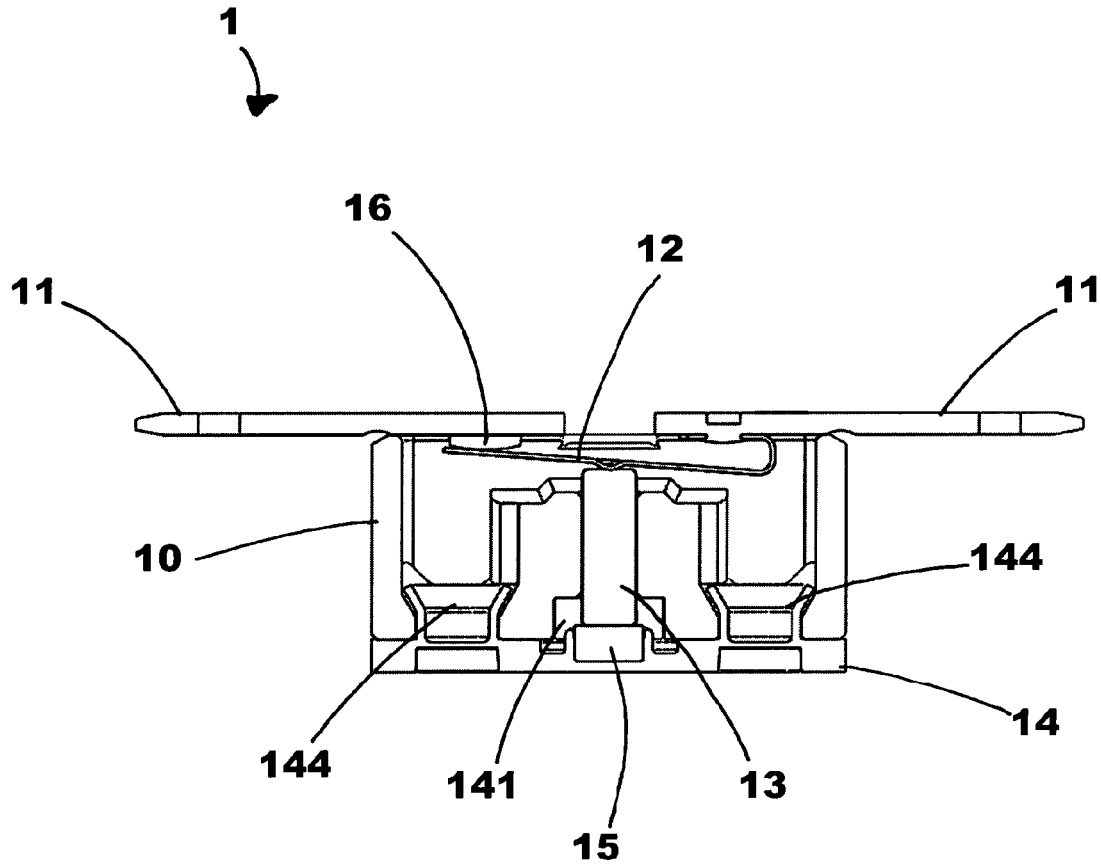
FIG. 8*b* shows a section through the thermal link from FIG. 8*a;*

FIG. 8*a* shows a perspective representation of a mounted thermal link 1 according to the embodiment from FIG. 2 and FIG. 8*b* shows a section through the thermal link 1 from FIG. 8*a* with the terminals 11, the inserting part 10, the heat transfer plate 14, the transmission pin 13, the fusible material insert 15, the fastening casings 144, the contact spring 12 and the fixed contact 16.

Figure 9:
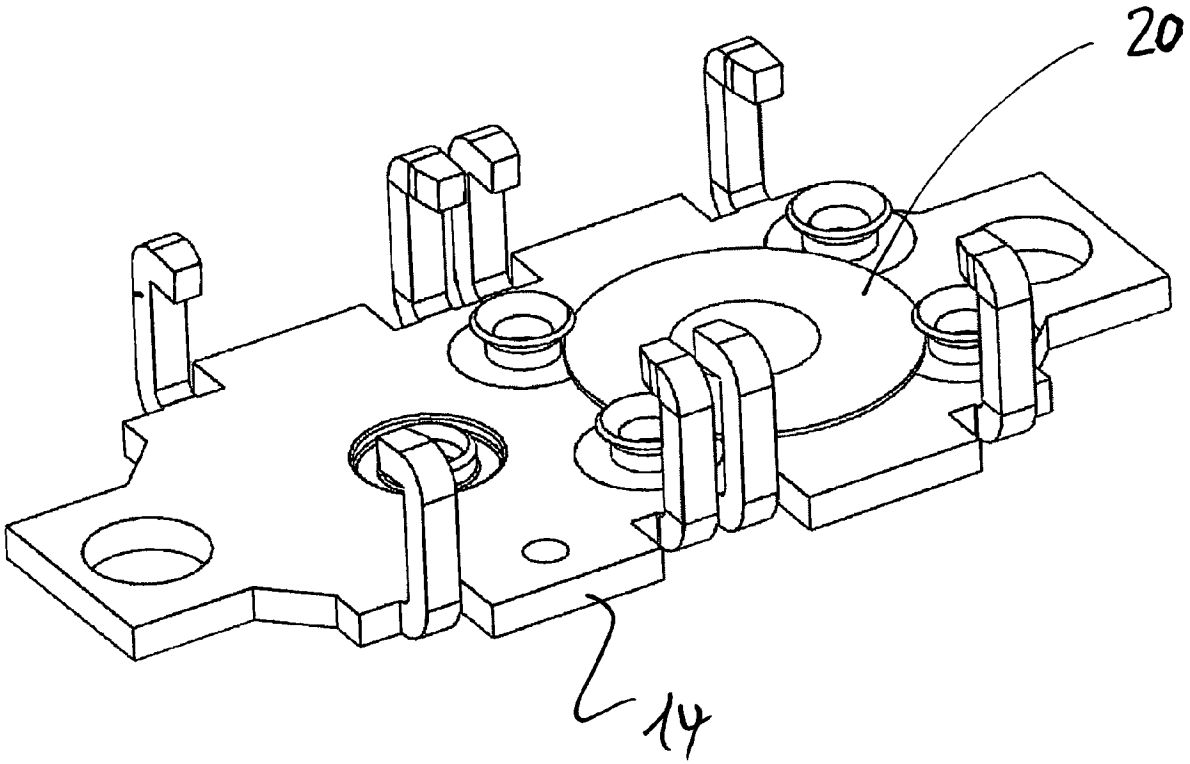
FIG. 9 shows a perspective representation of a common heat transfer plate according to the invention for the link from FIG. 1 and a temperature controller.

FIG. 9 shows a perspective representation of a common base plate 14 according to the invention for the thermal link from FIG. 1 and a further thermal link and/or a temperature switch and, in particular, a temperature switch 2 with a bimetallic element 20.

Figure 10:
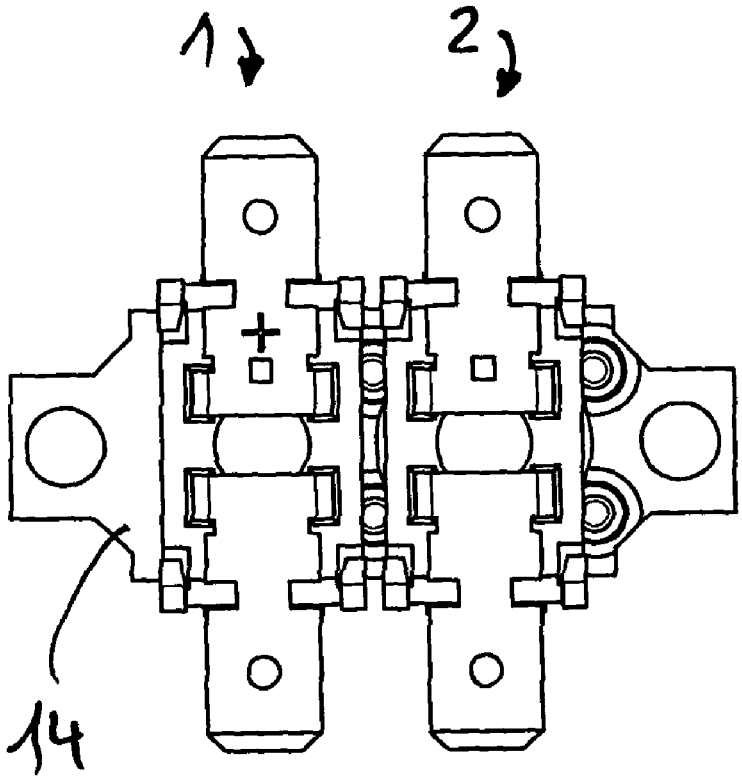
FIG. 10 shows a plan view of a thermal link and a temperature controller mounted on the heat transfer plate from FIG. 9.

FIG. 10 shows a plan view of a thermal link 2 and a temperature switch 2 that are mounted on a common heat transfer plate 14. It is clear that a common heat transfer plate 14 according to the invention may also be formed analogously for a thermal link 1 according to the second embodiment of the present invention from FIG. 2.

Figure 11:
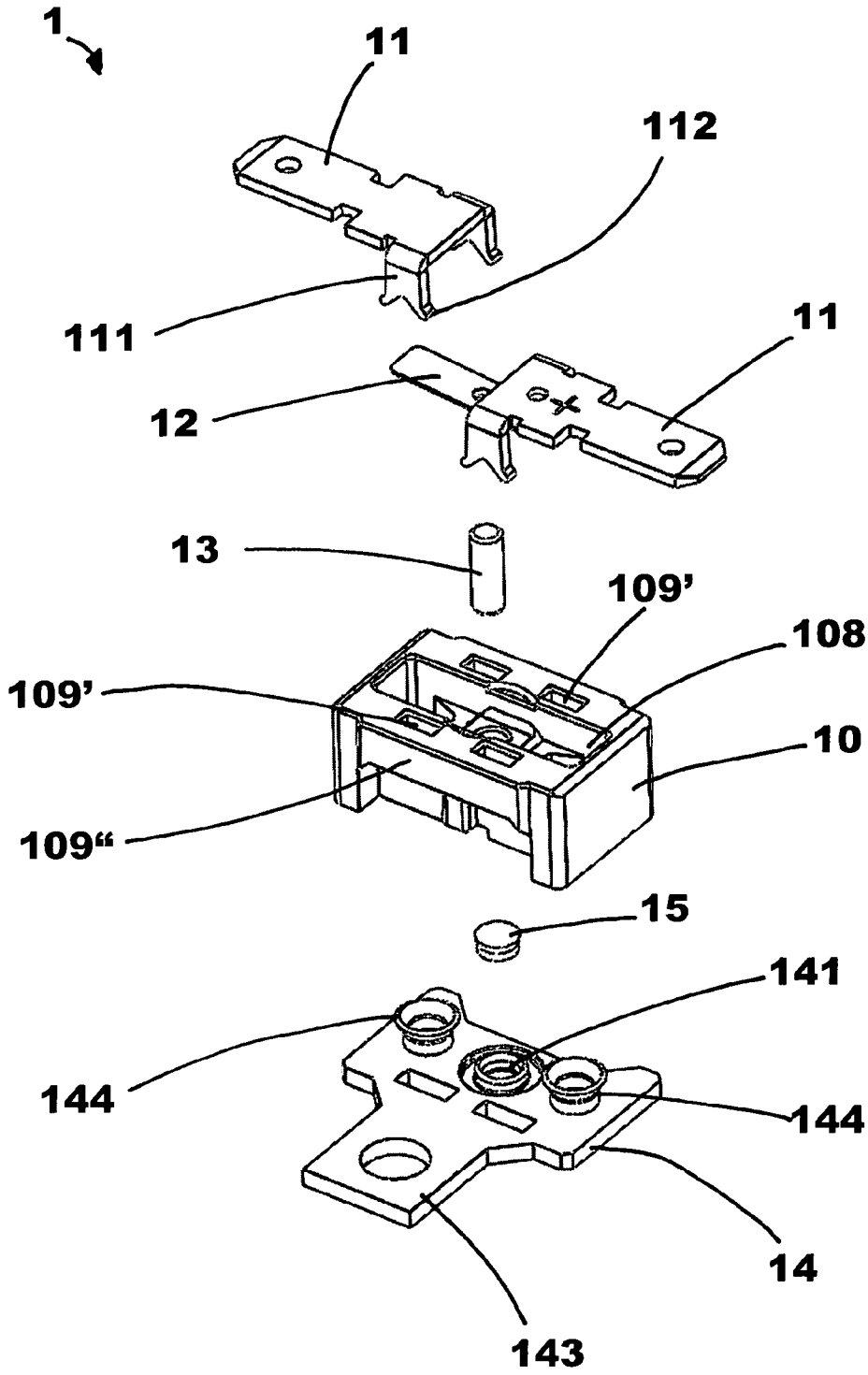
FIG. 11 shows a modification of the embodiment of the insulating part from FIG. 2.

FIG. 11 shows a modification of the embodiment from FIG. 2 and a perspective exploded representation of a thermal link as provided by a further embodiment of the present invention, comprising a heat transfer plate 14, an insulating part 10, a fusible material insert 15, a transmission pin 13 and electrical terminals 11. The embodiment from FIG. 11 corresponds to the embodiment from FIG. 2, with the difference that the insulating part 10 comprises lateral webs 109", in which two continuous recesses 109' for securing the legs 111 of the electrical terminals 11 are respectively formed. The embodiment from FIG. 11 is particularly advantageous, since the legs 111 that are arranged in the recesses 109' are held particularly securely by way of the bent-up clamps 112 on the underside of the webs 109".

It is also clear that a thermal link 1 according to the invention may also comprise a combination of the features of the first and second embodiments of the present invention according to FIGS. 1 and 2 that are described above.

LIST OF DESIGNATIONS

Thermal link 1
Insulating part 10
Hole 101
Bottom 102
Recess 103
Foot part 104
Outer graduation 105
Inner graduation 107
Inner recess 108
Lateral recess 109, 109'
Lateral web 109"
Electrical terminals 11
Leg 111
Clamp 112
Contact spring 12
Pin 13
Heat transfer plate 14
Casing 141
Depression 142
Fastening arm 143
Casing 144
Fusible material insert 15
Fixed contact 16
Temperature switch 2
Bimetallic element 20

The invention claimed is:

1. A thermal link for electrical appliances, comprising
an insulating part with electrical terminals and a contact spring for providing an electrical connection between the terminals,
a fusible material insert as a thermal trip, and
a transmission pin, which is displaceably mounted in the insulating part and engages at its one end with the fusible material insert and at its other end with the contact spring,
wherein the insulating part is mounted on a heat transfer plate,
the fusible material insert is arranged in a casing that is in one piece with the heat transfer plate,
at least one recess with an inner graduation is formed in the insulating part, and
an upper rim of the casing engages around the inner graduation so that the heat transfer plate is firmly connected to the insulating part.

2. The thermal link as claimed in claim 1, wherein: an annular depression is formed around the casing in the heat transfer plate.

3. The thermal link as claimed in claim 1, wherein: tile pin is arranged in a through-hole of the insulating part, and a circular recess is formed on the bottom of the insulating part, within. which recess the hole is formed.

4. The thermal link as claimed in claim 1, wherein: the inside diameter of the casing corresponds approximately to the diameter of the pin, so that the fusible material is largely enclosed by the casing, the transmission pin and the heat transfer plate.

5. The thermal link as claimed. in claim 4, wherein: the fusible material is pressed into the casing.

6. The thermal link as claimed in claim 1, wherein: the insulating part comprises two lateral foot parts in contact with the heat transfer plate, a bottom of the insulating part being at a distance from the heat transfer plate.

7. The thermal link as claimed in claim 1, wherein: the insulating part comprises two recesses and a first drawn casing and a second drawn casing are drawn from the heat transfer plate so that the casing is arranged between the first and second drawn casings.

8. The thermal link as claimed in claim 1, wherein: the heat transfer plate and the insulating part are formed in such a way that the heat transfer plate can be fitted with the insulating part and the fusible material insert from above, and the insulating part can be fitted with the transmission pin and the terminals likewise from above.

9. The thermal link as claimed in claim 1, wherein: the heat transfer plate is formed in one piece with a base plate and includes at least one further thermal link and/or a temperature switch.

10. A method for producing a thermal link as claimed in claim 1, comprising:

the casing for receiving the fusible material insert and drawn casings for connecting the heat transfer plate to the insulating part are drawn from the heat transfer plate;

the fusible material insert is inserted into the casing and stamped;

the insulating part is placed onto the heat transfer plate and is connected to the inner graduations of the inner recesses with a form fit by way of the drawn casings.

11. The method as claimed in claim 10, wherein: the drawn casings are connected to the inner graduations of the recesses with a form fit by means of a stamp that is inserted from above into the recesses and is formed in such a way that the rims of the drawn casings engage around the graduations with a form fit.

12. The method as claimed in claim 10, comprising: the fitting of the heat transfer plates with the fusible material insert, the insulating part, the transmission pin and the terminals is performed from above.

13. A thermal link for an electrical appliance, comprising:

an insulating part with electrical terminals and a contact spring for providing an electrical connection between the terminals, a fusible material insert as a thermal trip, and a transmission pin, which is displaceably mounted in the insulating part and engages at its one end with the fusible material insert and at its other end with the contact spring, wherein the fusible material insert is arranged in a casing that is in one piece with the heat transfer plate, and an annular depression is formed around the casing in the heat transfer plate.

14. A thermal link for an electrical appliance, comprising:

an insulating part with electrical terminals and a contact spring for providing an electrical connection between the terminals, a fusible material insert as a thermal trip, and a transmission pin, which is displaceably mounted in the insulating part and engages at its one end with the fusible material insert and at its other end with the contact spring, wherein the insulating part is mounted on a heat transfer plate, the fusible material insert is arranged in a casing that is in one piece with the heat transfer plate, and the insulating part comprises two lateral foot parts in contact with the heat transfer plate, a bottom of the insulating part being at a distance from the heat transfer plate, and suitable lateral graduations, which correspond to fastening arms extending from the heat transfer plate, are formed on the insulating part, and the fastening arms engage at their ends around the raduations, so that the insulating part is firmly arranged on the heat transfer plate.

* * * * *

UNITED STATES PATENT AND TRADEMARK OFFICE

CERTIFICATE OF CORRECTION

PATENT NO. : 8,164,412 B2
APPLICATION NO. : 11/922907
DATED : April 24, 2012
INVENTOR(S) : Peter Sieber, Roland Wolf and Lutz Pahlke It is certified that error appears in the above-identified patent and that said Letters Patent is hereby corrected as shown below:

In the front page, Item (73), Assignee: change "Inner Control Hermann Kohler Electrik GmbH &Co. KG, Nuremberg" to --Inter Control Hermann Kohler Elektrik GmbH & Co. KG, Nurnberg--.

Signed and Sealed this
Third Day of July, 2012

David J. Kappos

David J. Kappos
*Director of the United States Patent and Trademark Office*